US008235190B2

(12) United States Patent
Porte et al.

(10) Patent No.: US 8,235,190 B2
(45) Date of Patent: Aug. 7, 2012

(54) CUP HOLDER FOR WHEELED LUGGAGE

(75) Inventors: Karen Porte, Denver, CO (US); Douglas P Collins, Loveland, CO (US); Kenneth W House, Fort Collins, CO (US)

(73) Assignee: FLI, LLC, Denver, CO (US)

( * ) Notice: Subject to any disclaimer, the term of this patent is extended or adjusted under 35 U.S.C. 154(b) by 350 days.

(21) Appl. No.: 12/201,450

(22) Filed: Aug. 29, 2008

(65) Prior Publication Data

US 2010/0051633 A1 Mar. 4, 2010

(51) Int. Cl.
*B62B 1/00* (2006.01)

(52) U.S. Cl. ..... 190/102; 190/100; 248/102; 248/205.2; 248/311.2; 248/104; 248/106; 248/107; 220/737; 280/642

(58) Field of Classification Search ..... 190/102, 190/100; 220/737; 248/311.2, 102, 104, 248/315

See application file for complete search history.

(56) References Cited

U.S. PATENT DOCUMENTS

| | | | | | |
|---|---|---|---|---|---|
| 2,359,452 | A | * | 10/1944 | Summers, Sr. | 248/104 |
| 3,473,682 | A | | 10/1969 | Studen | |
| 5,106,046 | A | * | 4/1992 | Rowles et al. | 248/311.2 |
| D329,628 | S | | 9/1992 | Runkel | |
| 5,147,067 | A | | 9/1992 | Effertz | |
| 5,193,304 | A | * | 3/1993 | Krueger | 47/67 |
| 5,395,085 | A | * | 3/1995 | Mann | 248/311.2 |
| 5,464,183 | A | | 11/1995 | McConnell | |
| 5,480,078 | A | | 1/1996 | Verrette | |
| 5,511,754 | A | * | 4/1996 | Johannsen | 248/311.2 |
| 5,573,152 | A | * | 11/1996 | Arnold | 224/148.4 |
| 5,639,052 | A | * | 6/1997 | Sauve | 248/311.2 |
| 5,927,661 | A | * | 7/1999 | Tinsley et al. | 248/102 |
| 6,138,882 | A | | 10/2000 | Buettner | |
| 6,328,146 | B1 | | 12/2001 | Siwak | |
| 6,601,803 | B1 | * | 8/2003 | Juranek | 248/102 |
| 6,609,599 | B1 | | 8/2003 | Chang | |
| 2003/0042091 | A1 | | 3/2003 | Oh | |
| 2003/0141424 | A1 | * | 7/2003 | Thomas | 248/311.2 |
| 2006/0022006 | A1 | | 2/2006 | Cruise | |
| 2006/0037825 | A1 | * | 2/2006 | Dayton et al. | 190/110 |
| 2006/0219745 | A1 | * | 10/2006 | Riley | 224/400 |
| 2006/0243768 | A1 | | 11/2006 | Dowell | |
| 2007/0089953 | A1 | | 4/2007 | Kohn | |
| 2007/0199947 | A1 | * | 8/2007 | Matlovich | 220/737 |

* cited by examiner

*Primary Examiner* — Anthony Stashick
*Assistant Examiner* — Cynthia Collado
(74) *Attorney, Agent, or Firm* — The Law Firm of Andrea Hence Evans, LLC

(57) ABSTRACT

Beverage holders adapted to attach to the upwardly extending arms of the handle assembly of a wheeled piece of luggage are described herein. The holders are adapted to twist and pivot when holding a cup with a beverage contained therein to maintain the axis of the beverage cup in a position generally orthogonal with a flat ground surface. The mechanism permitting the pivoting typically comprises a pair of opposing suspension arms that are fabricated of an elastomeric polymer that has sufficient tensile strength to support a beverage cup filled with a beverage but also has a sufficiently low flexural modulus to permit the cup to pivot when the angle of the handle assembly relative to the ground is changed.

10 Claims, 5 Drawing Sheets

CUP HOLDER FOR WHEELED LUGGAGE

FIELD OF THE INVENTION

The invention relates to a cup holder configured for attachment to wheeled luggage.

BACKGROUND

Transporting luggage from a vehicle to an airport check-in counter or onto a plane itself or vice versa can be an act in acrobatics. This is especially so for persons travelling individually, such as business travelers. They have to juggle their main piece of luggage along with one or two carry-on items, such as a brief case.

Another attribute of our modern society is that people are often sleep deprived. There is just too much going on in their lives to spend 8 or more hours everyday sleeping. As such, increasing numbers of people rely upon one or more cups of coffee during the day and especially in the morning as a pick-me-up. Of particular popularity are high-end cups of coffee supplied in the ubiquitous Styrofoam™ or paper cups. At times, it seems that there is a different coffee shop on every block enticing us to buy more of this seemingly essential beverage. Many of these shops have drive-throughs so that we don't even have to leave our vehicles. Airport lobbies and concourses also tend to have coffee shops or carts every few hundred feet or so.

Weary and laden air travelers are often burdened with having to juggle their main piece of luggage, an over the shoulder carry-on, a newspaper or book, their ticket and identification as well as their beloved cup of coffee. Furthermore, when traveling with small children travelers must have one or both hands free to hold their children's hands. There is a lack of convenient and suitable means available to facilitate carrying all these items at once without the risk of wholly or partially spilling the coffee.

Several prior art references teach cup holders that are designed for use on a wheeled piece of luggage. US patent application publication 2006/0022006 describes a pouch that hangs from an extended handle of a piece of wheeled luggage. The pouch is suspended from fabric straps that allow it to pivot as the angle of the luggage and handle vary as the unit is wheeled about. The inherent flexibility of the fabric pouch, however, makes any open ended cup particularly susceptible to incidental spillage. Further, the high location of the pouch (near the top of the extended handle) greatly increases the risk that it will be inadvertently knocked by the traveler's leg or arm. Ultimately, this pouch type holder is reliably suitable for only securely closed containers, such as water bottles.

US patent application publication 2006/0037825 describes a more rigid holder that is much more suited to carrying coffee cups than the aforedescribed pouch. Specifically the unit is substantially rigid and includes a mechanism to permit it to pivot between the upwardly extending arms of the handle assembly. This design, however, requires pivoting blocks to be permanently located in the handle arms so it is not readily adaptable to existing luggage but rather intended for luggage configured to use the holder. Further, because the unit relies on fixed mounting locations in the handle arms, it does not offer the user much if any ability to adjust the location of the holder to suit his or her preferences. Finally, the complexity of this holder, as well as several other holders described in the prior art, increase the cost to manufacture and sell such that widespread adoption of the holder is unlikely.

DETAILED DESCRIPTION

Figure 1:
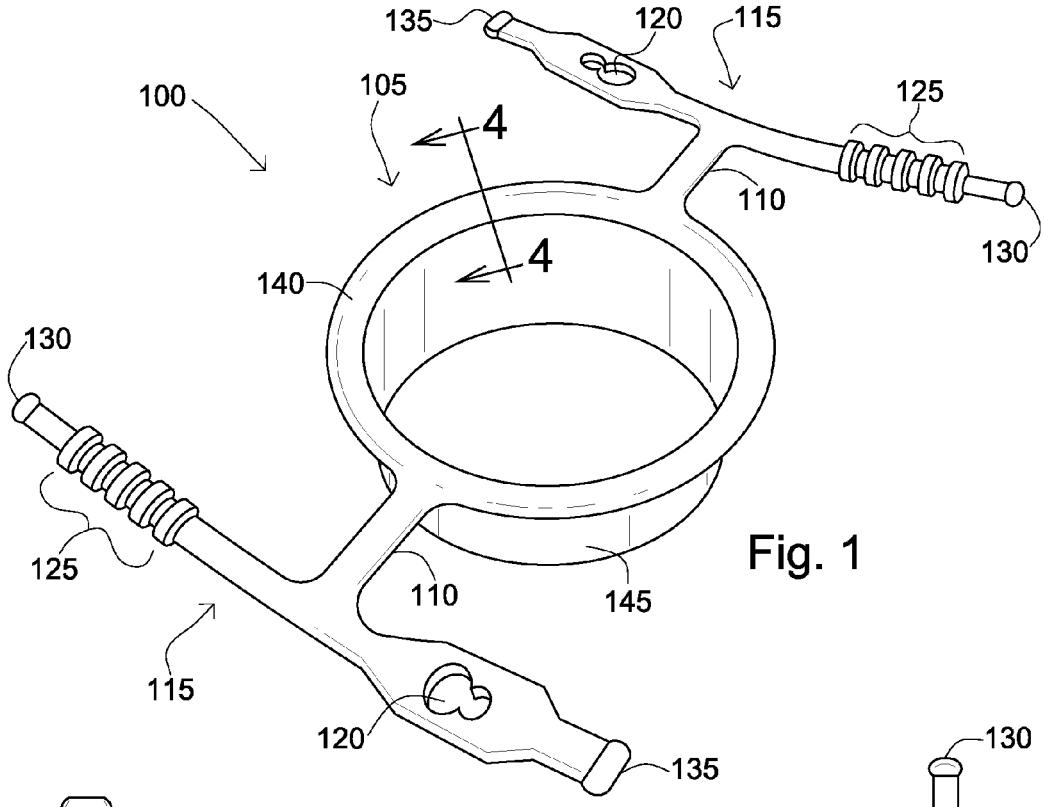
FIG. 1 is an isometric illustration of the cup holder according to an embodiment of the invention.

Embodiments of a beverage holder adapted to attach to the upwardly extending arms of the handle assembly of a wheeled piece of luggage are described herein. The holders are adapted to twist and pivot when holding a cup with a beverage contained therein to maintain the axis of the beverage cup in a position generally orthogonal with a flat ground surface. The mechanism permitting the pivoting typically comprises a pair of opposing suspension arms that are fabricated of an elastomeric polymer that has sufficient tensile strength to support a beverage cup filled with a beverage but it also has a sufficiently low flexural modulus to permit the cup to pivot when the angle of the handle assembly relative to the ground is changed. Advantageously, the beverage contained within the cup is inhibited from spilling as a traveler wheels his/her luggage from one destination to another. Through the use of embodiments of the holder, a traveler's hand is freed to juggle luggage, children, and other items making the trip through an airport terminal or concourse a bit less burdensome. Further, because the beverage is securely retained in the holder, the traveler need not worry about having to set his/her beverage cup on unsanitary surfaces, such as in restrooms or on the floor in the boarding gate areas.

In at least one embodiment, the opposing suspension arms are integrally molded from the elastomeric polymer in combination with (i) respective strap members adapted to couple the holder to the spaced apart arms of the handle assembly, and (ii) a cup-receiving ring adapted to cradle a frustoconical cup therein. Accordingly, the holder can be produced very economically especially when compared to prior art wheeled luggage cup holders.

In variations of the foregoing, the receiving ring is molded over a thin plastic frustoconical sleeve. The sleeve acts to stabilize the cup in the holder by adding rigidity to the holder and increasing the contact surface area between the cup and the holder. In at least one variation, the sleeve is further configured to be at least partially collapsible enhancing the holder's ease of storage, such as in a pocket of the associated luggage when not being used.

The frustoconical sleeve also provides an outwardly facing circumferential surface upon which indicia can be printed or even molded into the sleeve. Accordingly, considering the holder's potential low cost, it can be given away as a promotional item emblazoned with a company indicia.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of ±20%. Also, as applicable, the term "substantially" as used herein unless otherwise indicated means a margin of ±10%. Concerning angular measurements, "about" or "generally" refers to ±15 degrees and "substantially" refers to ±7.5 degrees unless otherwise indicated. It is to be appreciated that not all uses of the above terms are quantifiable such that the referenced ranges can be applied.

As used herein the term "indicia" refers to intentional markings appearing on an associated article. The markings can comprise alphanumeric characters, logos and/or other graphical representations. The marks can be printed on the article, affixed with an appliqué, integrally fabricated on the surface of the article and/or applied to the article in any suitable manner.

As used herein, the term "living pivot" refers to a unitary structure that permits a first portion of the structure to rotate, or pivot, relative to a second portion through a common axis of the first and second portions by way of resilient elastic deformation of the structure's material. A "living pivot" is akin to a living hinge in that it does not comprise multiple distinct intermoving parts.

AN EMBODIMENT OF A BEVERAGE HOLDER ADAPTED FOR USE ON WHEELED LUGGAGE

Figure 3:
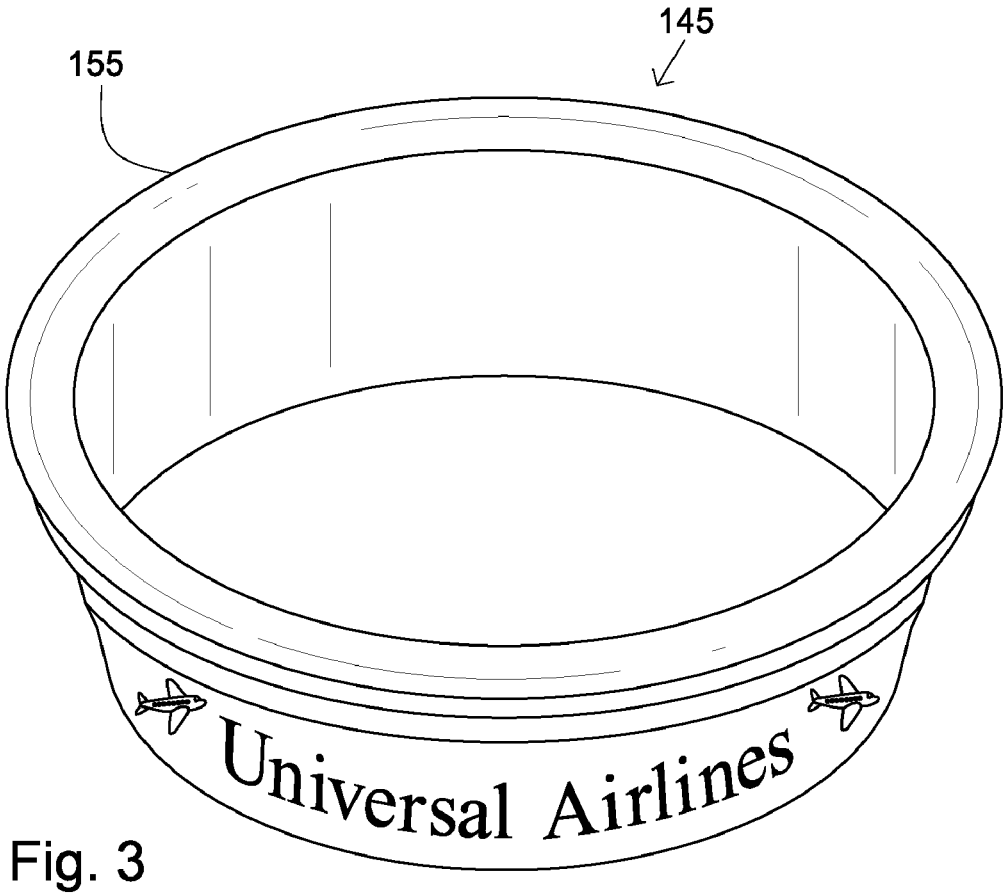
FIG. 3 is an isometric illustration of the cup-receiving ring of the cup holder according to an embodiment of the invention.
Figure 4:
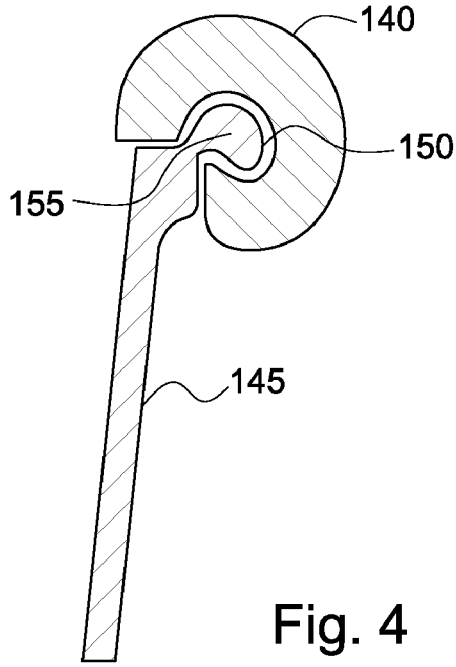
FIG. 4 is a cross-sectional side view of the interface between the receiving ring and the elastomeric pivot and attachment structure according to an embodiment of the invention.
Figure 5:
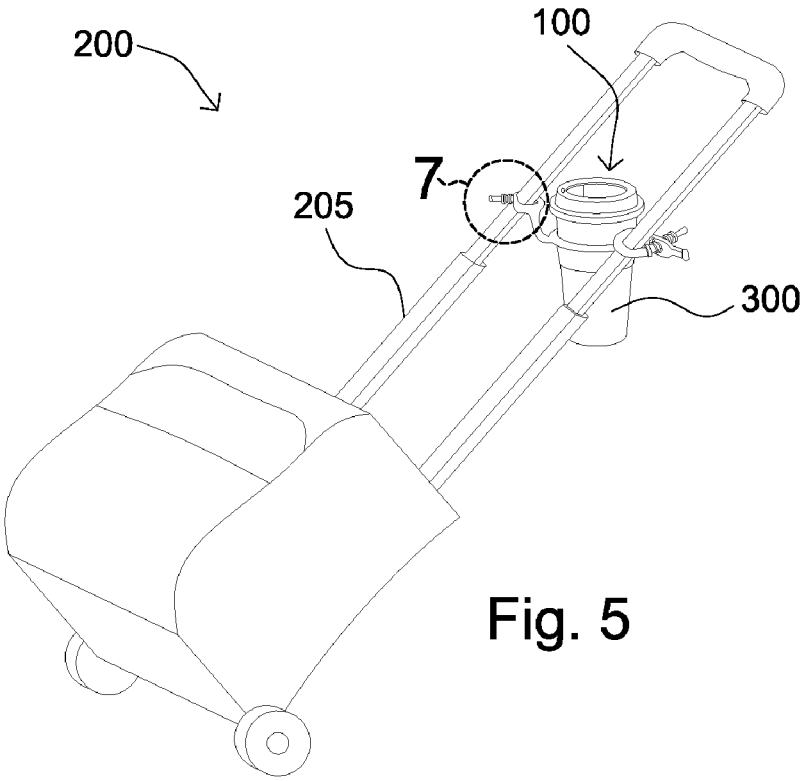
FIGS. 5 & 6 are isometric illustrations of the cup holder attached to a handle assembly of a piece of wheeled luggage with a beverage cup contained in the holder according to an embodiment of the invention.
Figure 6:
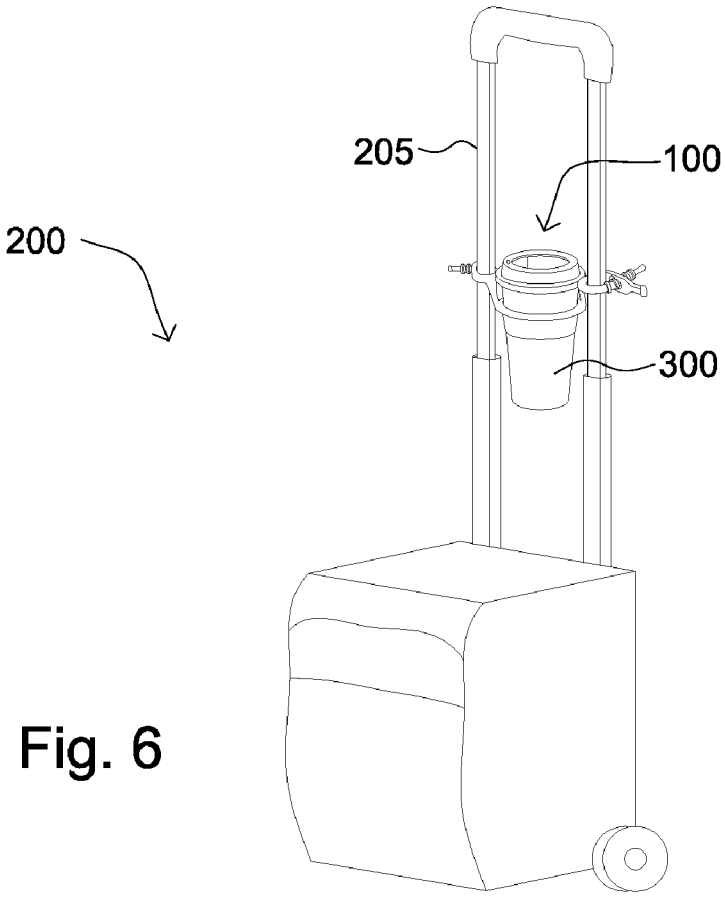

FIGS. 1-4 and 7 are illustrations of one embodiment of a beverage holder adapted for use with a piece of wheeled luggage. FIGS. 5 & 6 illustrate the holder attached to the extended arms of the luggage's handle assembly.

Figure 2:
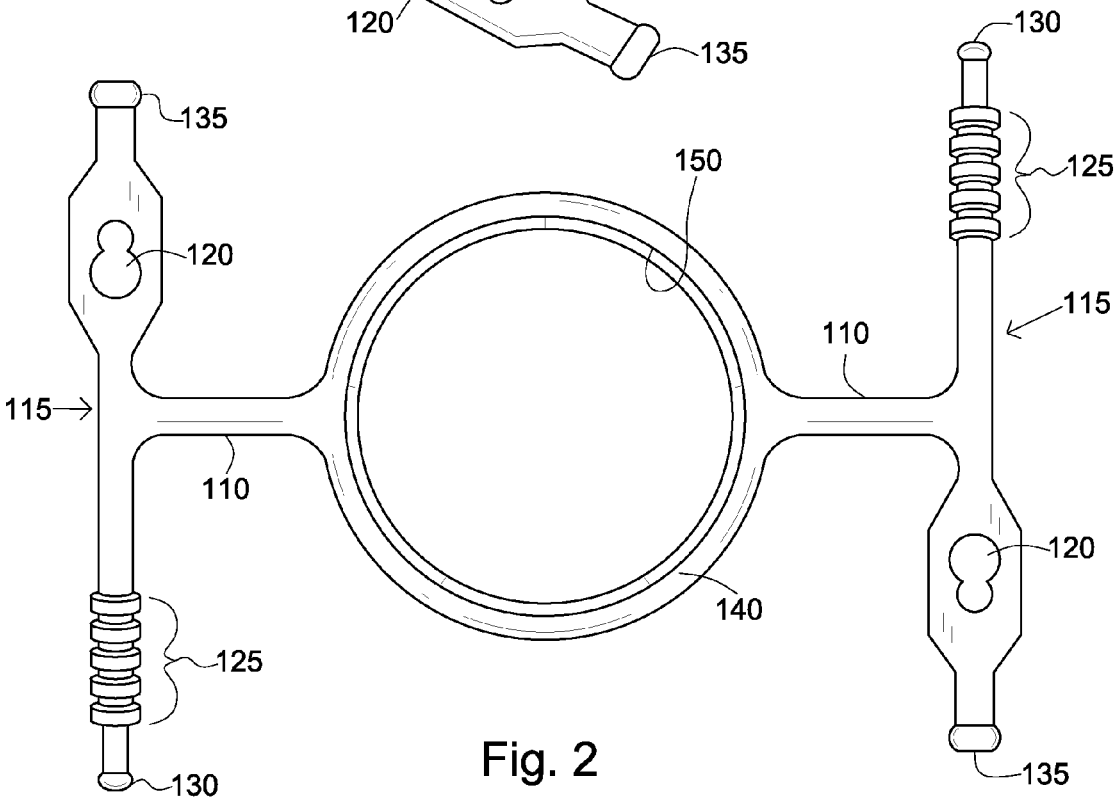
FIG. 2 is a bottom view of the cup holder according to an embodiment of the invention.

Referring primarily to FIGS. 1 & 2, the holder comprises two pieces: a pivot and support structure 105 comprised of an elastomeric polymer; and a plastic cup support sleeve 145 (also shown separately in FIG. 3). The pivot and support structure typically comprises several distinct portions including: left and right strap portions 115; left and right suspension arm portions 110; and a cup-receiving ring 140. A lip 155 of the sleeve is received into a slot 150 (see FIG. 4) formed in the receiving ring. Typically, the receiving ring along with the entire integrally molded pivot and support structure is over molded around the lip of the previously produced sleeve.

The strap portions 115 are typically spaced apart from each other about five to eight inches with six inches being most typical to facilitate the holder being secured to the spaced arms of most handle assemblies 205 on wheeled luggage 200. When in their unfolded or deployed configuration the straps are essentially linear comprising a male end 130 and a female end 135 that are adapted to couple when secured around an arm of the handle assembly (see FIG. 7). Each strap portion is integrated with the suspension arm portions 110 proximate, but not necessarily at, a midpoint location.

As illustrated, the male end 130 comprises a plurality of annular ridges 125 spaced apart by at least the thickness of female end 135. The spaces between the ridges comprise valleys having a smaller diameter than the ridges which flank them. Five ridges are illustrated in the figures; however, the exact number can vary.

The female end 135 comprises a flattened portion wherein a pair of generally circular intersecting openings 120 extend therethrough. The innermost opening (the one located closest to the intersection with the associated suspension arm portion 110) typically has a larger diameter than the outermost opening. Specifically, the diameter of the innermost opening is greater than the diameter of the annular ridges 125 so that the male portion can be slid therethrough; whereas, the outermost opening has a diameter that is less than that of the annular ridges but at least slightly greater than that of the valleys between the ridges. Further the width of the intersection of the two openings is less than the diameter of the valleys.

Figure 7:
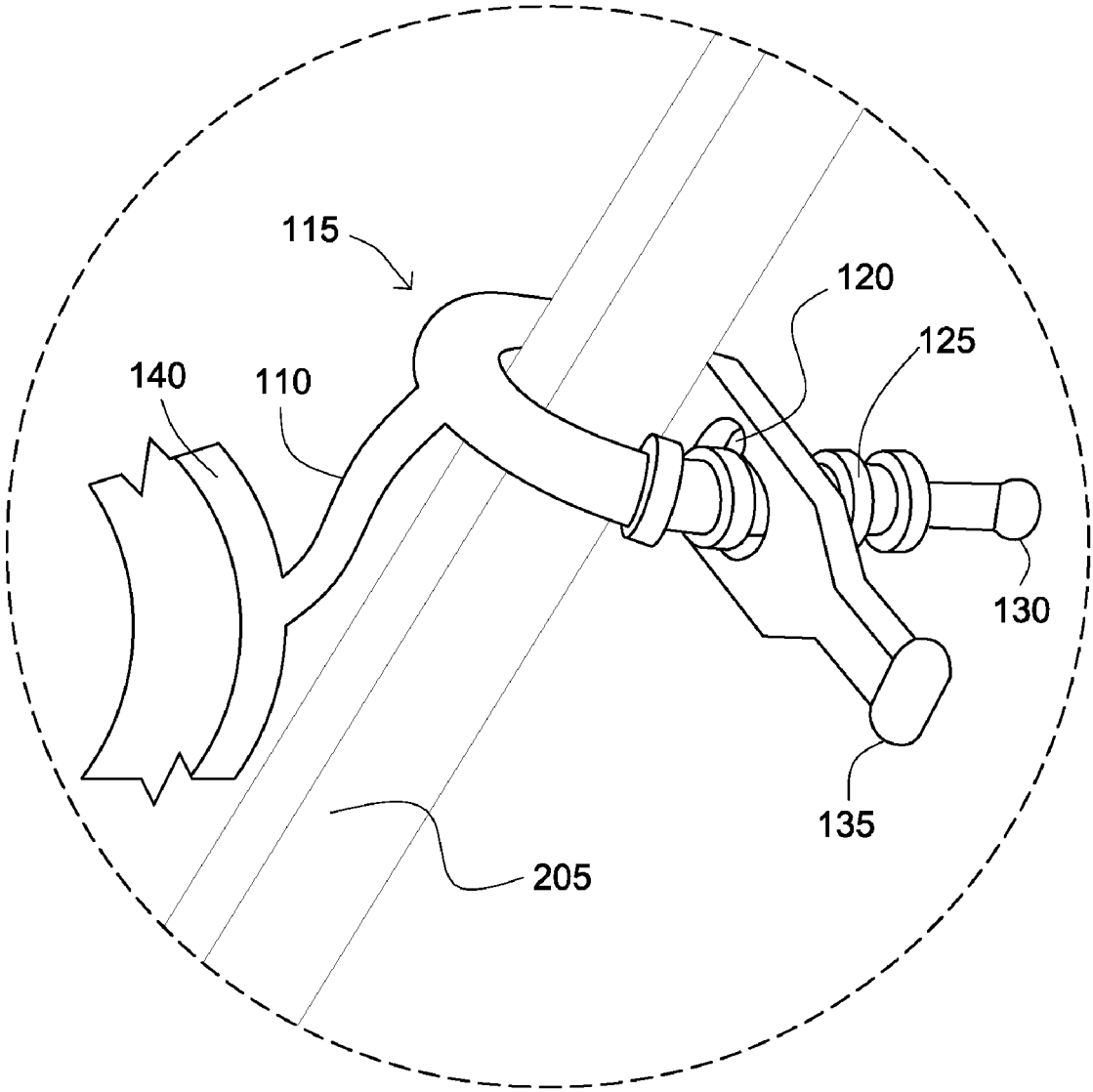
FIG. 7 is a partial isometric illustration of the cup holder showing it attached to an arm of the handle assembly of a piece of wheeled luggage according to an embodiment of the invention.

The straps 115 are typically wrapped around the extended arms 205 of the handle assembly and secured as best shown in FIG. 7. Specifically, the male end 130 is slid through the larger innermost opening of the female end 135 typically until the strap is taut against the respective arm. An annular valley is then encouraged into the smaller outermost opening of the female end across the intersection with the larger opening to effectively secure the strap in place. At least a small amount of force is required to encourage the annular valley across the intersection as the width of the intersection is less than the diameter of the male end's valleys wherein the width of the intersection elastically deforms to allow the male end into the smaller opening. After passage through the intersection, the intersection resiliently springs back into its original shape helping to hold the male end in place.

Of particular note is that the smaller opening is located outwardly of the larger opening and that the male end 130 is biased against and into the portion of the smaller opening generally opposite the intersection by the natural resiliency of the male and female ends as they continuously attempt to spring back to their as-molded linear configuration (as shown in FIG. 1 for instance). Further, loading the holder 100, such as with a beverage laden cup 300, the male end is further biased into the smaller opening. Accordingly, absent a purposeful application of a counterforce to the male end the annular valley remains securely retained within the smaller opening.

Other integrated or partially-integrated strap designs are also contemplated. For instance, in one variation the male end can comprise a tapered bulb that is slid and forced through an opening on the female end wherein the female end resiliently deforms to allow the bulb to pass therethrough and springs back to its original shape to hold the strap closed until a suitable counterforce is applied to free the bulb and disconnect the strap. Multiple openings can be provided along the female end to allow the straps closed length to be adjusted for handle arms of different sizes.

Referring primarily to FIG. 1, an elongated suspension arm portion 110 extends from each strap portion 115 at one end and the cup-receiving ring 140 at the other end. The length of the suspensions arms can vary depending on the total span of the holder between the straps 115 but in at least one variation they are each about 1.0-1.5" long.

The suspension arm portions 110 can have any suitable cross section and cross-sectional dimensions depending on the particular elastomeric material of which the holder 100 is comprised. Ideally, the suspension arms should be substantial enough in cross section to apply a small restorative force to the receiving ring to maintain the unit's normal unstressed orientation when unloaded, but be flexible enough to allow the cup-receiving portion 105 to pivot when the holder is laden with a beverage containing cup 300 to maintain the cup opening's generally normal orientation relative to gravity. The cross-sectional area of the suspension arm must also be sufficient to impart the necessary strength to the holder to support beverages of various sizes that can be carried in the holder. Additionally, the area of the cross section should be large enough to help dampen and minimize any oscillation that could occur when the angle of the suitcase 200 and associated handle arm assembly 205 are changed quickly and the holder 100 and beverage 300 adjust to the new orientation.

In one variation of the cup holder comprising an elastomer having a Shore hardness of about 70 A, the width of the suspension arms 110 are each about 0.30" with a thickness of about 0.125" for a cross-sectional area of about 0.040 square inches. The suspension arms typically have generally ovular or rectangular cross sections although variations are contemplated with other cross-sectional shapes such as circular. It is also to be appreciated that the cross-sectional area and shapes of the arms can vary over their lengths. For instance, in one variation the suspension arm necks down to a smaller cross-sectional area along its length to encourage any pivotal movement to occur thereat.

The function of the suspension arms 110 are essentially two fold: (1) support the cup-receiving ring 140 and any beverage 300 received therein; and (2) act as a living pivot permitting the beverage's orientation to adjust as the angle of the handle arms 205 are varied relative to the ground. As indicated above, the properties of the elastomer combined with its cross-sectional area provides a torsional bias whenever the suspension arms are twisted relative to their normal inclination. This torsional bias is desirable in that it helps minimize the tendency of the beverage to begin to oscillate in the holder when the handle arms are moved from one position, such as vertical, to another position, such as 45 degrees relative to ground. In contrast, a holder having a pair of opposed generally frictionless pivots isolating the cup from straps or other handle connectors would tend to oscillate back and forth until settling into a stable orientation with the cup's opening normal to gravity. On cups that are substantially or mostly full, the oscillation could cause sloshing of the beverage resulting in spillage. Furthermore, changes in the orientation of the handle arms before the oscillation associated with a previous angle change had dampened could accentuate the oscillation further increasing the risk of spillage.

Considering the magnitude of the torsional bias, or resistance to twisting of the living pivot suspension arm 110, the actual angle of the cup's opening to gravity (or vertical) will vary depending on the angle of the handle arms 205 and the weight of the combined cup and beverage 300. It is appreciated, however, that the angle will typically be shallow relative to the direction of gravity such that the beverage in the cup does not easily spill. For instance in one variation, when a typical 12 ounce beverage cup is filled with about 1 ounce of a beverage, the cup pivots about 45 degrees when the handle arms 205 are moved from vertical to horizontal. While 45 degrees off of vertical does present a cup opening with a significant tilt, one ounce of liquid is such a small amount that the surface of the beverage is still contained well below the edge of the cup opening. When the cup is filled with 4 ounces or more of beverage the angle of tilt typically decreases to less than 15 degrees thereby minimizing the risk of spill even though the surface of the liquid is located closer to the cup opening.

As mentioned above, the cup-receiving ring 140 is also integrally molded with the suspension arms 110 and the associated straps 115 and is designed to cradle a tapered or frustoconical beverage cup 300 therein. The diameter of the ring can vary for differently sized cups but research has indicated that most common size frustoconical cups, whether for soft drinks, coffee or other beverages, have a mouth opening of about 3.5" in diameter and taper at a relatively shallow angle. Accordingly, a ring having a diameter of about 3.0-3.25" has found to suitably cradle most cups.

It is generally desirable to have the ring 140 cradle the cup close to the cup's mouth opening wherein the center of gravity of the cup 300 especially when filled with a beverage is well below the pivot axis as defined by the suspension arms 110. As can be appreciated as the center of gravity approaches the pivot axis, the cup and associated receiving ring will not react as quickly to changes in handle assembly angles to the point where the cup will not react at all when the pivot axis passes through the center of gravity. If the center of gravity were above the pivot axis the cup and holder would be unstable and encourage spillage rather than prevent it. By having the ring cradle the cup near its top end, the cup itself without any beverage will typically have a center of gravity below the pivot axis and adding a beverage to the cup will only lower the center of gravity further.

As mentioned above the pivot and support structure 105, which comprises an integrally molded cup-receiving ring 140 and a pair of straps 115 and suspension arms 110 typically comprises an elastomeric polymer. The elastomer and its particular properties depend somewhat on the specified dimensions of the straps and the suspension arms but elastomers having a Shore A hardness of about 70 when utilized with elements having dimensions similar to those specified for the exemplary embodiment described herein have been determined to be desirable. Nevertheless, the foregoing should not be construed as indicating that elastomers having lesser or greater hardnesses would not be suitable for use in the holder provided the dimensions are appropriately modified.

One manner of manufacturing the pivot and support structure 105 is to injection mold it using a thermoplastic elastomer. Advantageously, high numbers of parts can be quickly and inexpensively produced in a fully-automated process. Of particular note is the generally flat or planar configuration of the pivot and support structure 105 as produced (as depicted in FIGS. 1 and 2), which can be produced with a relatively simple mold as opposed to a more three dimensional mold as would be required if the straps 115 and suspension arms 110 had to be molded in a shape closer to the shape they assume when in use, such as illustrated in FIGS. 5 & 6. Rather, the pivot and support structure takes on a three dimensional shape when in use but reverts to its flat configuration for storage, such as in a pocket of the luggage 200.

In some variations of the cup holder 100, the entire holder is integrally molded from the elastomer with the cup-receiving ring 140 alone supporting the cup 300. The ring can have any suitable dimensions to hold typical cup configurations securely including an inner diameter profile that tapers in a frustoconical manner to form an integral sleeve.

In other variations, such as the illustrated embodiment, the ring 140 interfaces with a thin plastic support sleeve 145 that tapers frustoconically to match the taper of the cups it is designed to cradle. The length of the tapered portion is typically about 0.5 to 0.75 inches and as such provides a large surface area on which suitable indicia can be provided, such as but not limited to advertising. The indicia can be printed on the surface, formed into the surface, applied by decal or sticker or attached in any other suitable manner.

The sleeve 145, as best shown in FIG. 3, is typically injection molded from an inexpensive rigid or semi-rigid plastic material, such as ABS, polypropylene or polyethylene. The top end typically includes a flanged lip 155 that interfaces with a corresponding slot 150 of the cup-receiving ring 140 as shown in FIG. 4. Where the pivot and support structure 105 comprises a thermoplastic elastomer, the cup-receiving ring is injection over-molded around the previously produced sleeve thereby forming the slot and effectively adhering the sleeve and ring together.

One purpose of the sleeve 145 apart from providing a surface for indicia, is to provide further support for a beverage-laden cup 300. Some beverage cups can be extremely flimsy and subject to collapse if subjected to localized side loading, such as from a person squeezing the cup in his/her hand or from a cup-receiving ring. Accordingly, for these types of cups it is desirable to maximize the surface of contact between the holder and the cup to better distribute the load transferred therethrough and minimize the risk of cup failure that could result in a spill. Additionally, the sleeve minimizes the chances that the cup can be received in the holder at a canted angle.

In at least one variation the sleeve 145 is relatively thin such that the sleeve can be collapsed or folded from a round configuration to a flat or nearly flat configuration for storage without incurring permanent damage. The sleeve excepting the flanged lip region can be as thin as 0.005-0.015" thick. In other variations, the sleeve may be made of a thicker material wherein the sleeve maintains its circular form and is resistant to being collapsed.

Referring to FIGS. 5 and 6, a typical embodiment of the holder 100 is designed for use in conjunction with a piece of wheeled luggage 200 to hold a beverage contained in a cup 300, such as a cup of coffee in a frustoconically shaped cup 300 as is routinely sold by hundreds of retail establishments across the country. More specifically, the cup holder is attached to the pair of arms of the luggage's extensible handle assembly 205 spanning between the arms. The cup holder can be secured to the arms anywhere along their lengths wherein by tightening the straps combined with the inherent frictional characteristics of the elastomeric material gripping the arms, the holder will be held firmly in place. However, for additional security a user can attach the holder at a location just above the top end of the lower tubular sections of the handle arms snuggly around the upper tubular sections. Accordingly, the straps are inhibited from sliding downwardly by the larger cross section of the lower tubular section. The straps 115 are secured to the handle arms by securing the male and female portions 130 & 135 of the straps together as described above.

The length of the suspension arms 110 are long enough to permit a particular holder to be used with a variety of different pieces of luggage having handle assemblies with arms 205 spaced apart different distances. For instance, a variation having a 6 inch span between straps can be used on a piece of luggage wherein the handle arms are spaced apart about 6 inches but also on a piece of luggage wherein the handles are spaced apart less than 6 inches, such as 4.5 inches. Simply, on the luggage with the more closely spaced handle arms, the suspension arms 110 extend both downwardly and across to the cup-receiving ring.

Once the holder 100 is attached to the handle assembly, a beverage containing cup 300 can be inserted into the holder 200. As the user moves the luggage from a parked or stationary upright position as shown in FIG. 6 to a tilted position wherein its bottom end rests on wheels for transport, the cup remains generally and suitably vertically orientated with the cup's mouth opening remaining generally normal to the direction of gravity. The luggage can be moved repeatedly between the vertical upright position and a tilted position approaching horizontal without undue concern that the beverage will spill out of the cup.

When the user is done with the beverage, he/she can discard the cup in any suitable fashion. Before stowing the handle assembly 205, a user will typically remove the cup holder 100 by unfastening the straps 115. The cup holder can then be stored in any suitable place such as a pocket of the luggage. In at least some variations the plastic sleeve 145 is collapsible permitting the holder to be folded to take up less space in the luggage.

A Beverage Holder Insert

Figure 8:
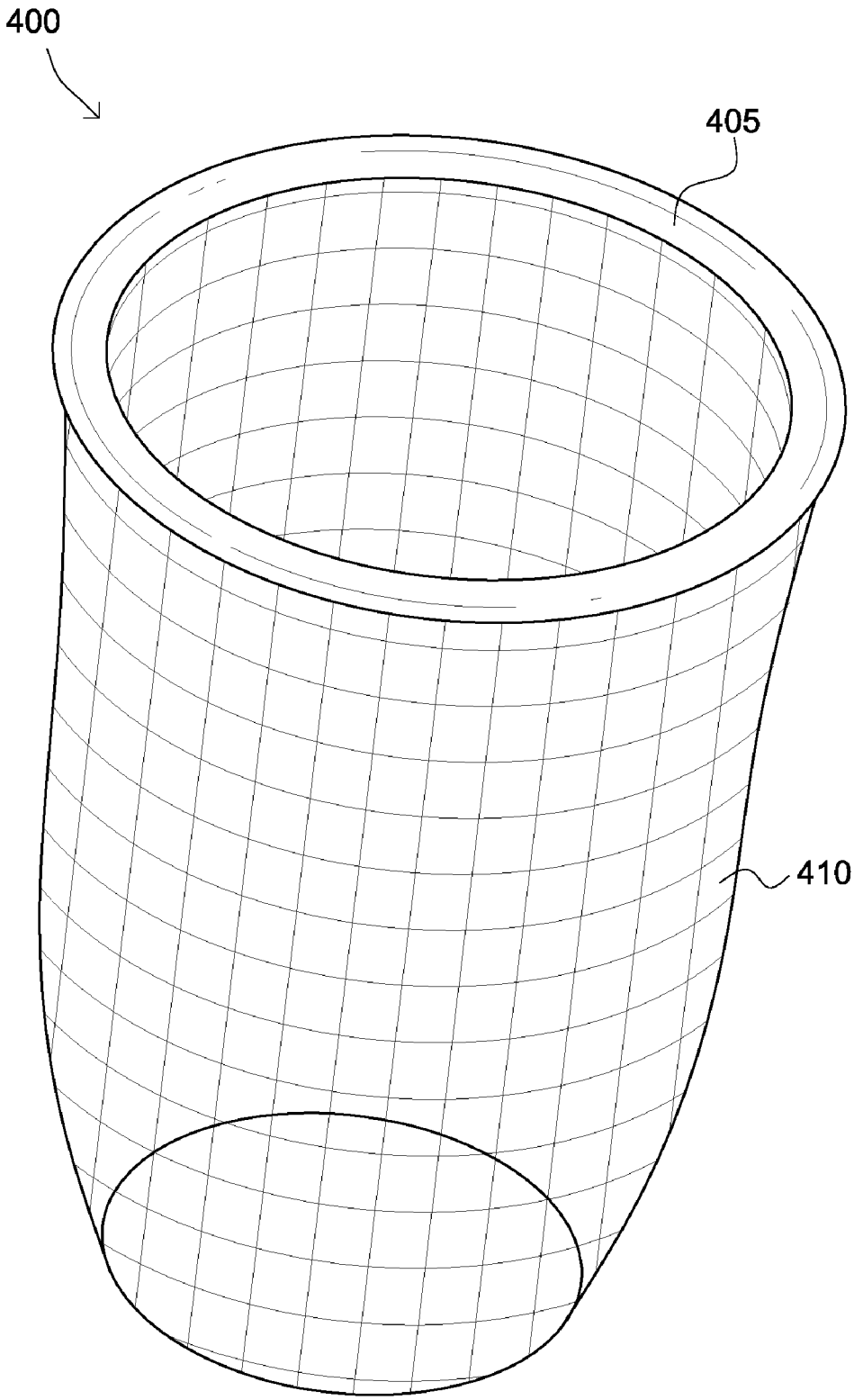
FIG. 8 is an isometric illustration of a drop in accessory for the cup holder of the embodiment illustrated in FIG. 1 that permits the use of the holder with water bottles and other containers that are not suitably frustoconically shaped according to an embodiment of the present invention.

In FIG. 8, a netted insert 400 is illustrated that can be received over the receiving ring 140 with the net extending downwardly through the ring to facilitate the transport of water bottles and non-tapered containers. The insert typically comprises a ringed lip 405 and a mesh net 410 extending downwardly therefrom.

The ringed lip portion 405 can be comprised of any suitable polymeric material including an elastomer similar to the material used for the holder or any other suitable semi-rigid or rigid plastic. In at least one variation, the ringed lip is overmolded around the lip or opening of the net. The ringed lip typically has inner and outer diameters generally similar to those of the holder's ring 140 such that the ringed lip rests upon and is supported by the holder's ring when the insert is placed into the holder. It is to be appreciated that the bottom surface of the ring can be contoured to interface and interlock with the holder's ring as desired to more securely couple the insert in place.

The mesh net can be comprised of any suitable fabric material such as a synthetic polypropylene or nylon mesh. The bottom of the net will typically comprise a flat piece of mesh fabric adapted to hold and retain the bottom of a water bottle or other cup therein.

The actual configuration of the insert and its various elements can vary significantly. For instance, at least one variation is contemplated wherein the net and ringed lip are integrally molded. In yet other variations, the entire insert can resemble a lipped cup having solid or partially solid sides in place of a mesh. An opening can be provided on the bottom side of the cup to allow liquid, such as that may condense on the side of a water bottle, to drain.

ALTERNATIVE EMBODIMENTS AND VARIATIONS

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, an embodiment is contemplated wherein the means for holding a cup, such as a cup-receiving ring, is produced separately from (i) the means for securing the holder to a handle assembly, such as the straps, and (ii) the living pivots. The holder is then fabricated by attaching or coupling the various members together. In such an embodiment, the cup holding means and the securing means can be fabricated from materials other than elastomers, such as rigid or semi-rigid plastics or from metals, while the living pivot can be fabricated from an elastomer. In another embodiment, the living pivots need not comprise an elastomeric material but rather comprise a suitable plastic formed into a living hinge with the longitudinal axis of the opposing hinges being aligned along a common axis that passes through or close to the center of a cup-receiving ring or other holding means.

We claim:

1. A holder for selectively receiving and retaining a container comprising:

a single unitary one piece pivot structure having a cup-receiving ring, wherein the cup-receiving ring features integral left and right suspension arm portions attached to the cup-receiving ring only on a top of a lip of the cup-receiving ring and extending between an area on the cup-receiving ring and a proximate midpoint location on left and right strap portions respectively, wherein the left and right strap portions have a first end section and a second end section that are adapted to couple when the holder is secured, wherein the left and right suspension arm portions and the left and right strap portions are along an identical plane as the top of the lip, and wherein the left and right strap portions are perpendicular to the left and right suspension arm portions, respectively.

2. The holder of claim 1, further comprising:

a cup support featuring a top end having an annular lip extending radially outward therefrom, wherein the annular lip is coupled with and supported by the cup-receiving ring.

3. The holder of claim 2, wherein the cup-receiving ring comprises an annular slot extending around an inside edge of the cup-receiving ring, the annular lip being received into the annular slot.

4. The holder of claim 1 wherein each strap portion has a multi-ridged first end section and the opposing second end section having a keyhole opening, the first end section having a plurality of annular ridges having a first diameter separated and spaced from each other by one or more annular valleys having a second diameter, the keyhole opening having partially intersecting generally circular first and second opening portions.

5. The holder of claim 1, wherein the pivot and attachment structure is injection molded.

6. The holder of claim 1, further comprising an insert comprising a ringed lip having a diameter generally similar to the cup-receiving ring and a mesh net attached to the ringed lip.

7. The holder of claim 2, wherein the cup support comprises indicia on an exterior surface thereof.

8. A combination comprising:

a piece of luggage, the piece of luggage comprising a body having an handle assembly comprising a pair of substantially parallel elongated arms and a handle; and a holder, the holder comprising a single unitary one piece pivot structure having a cup-receiving ring, wherein the cup-receiving ring features integral left and right suspension arm portions attached to the cup-receiving ring only on a top of a lip of the cup-receiving ring and extending between an area on the cup-receiving ring and a proximate midpoint location on left and right strap portions, respectively, wherein the left and right strap portions have a first end section and a second end section that are adapted to couple when the holder is secured to the elongated arms of the luggage, wherein the left and right suspension arm portions and the left and right strap portions are along an identical plane as the top of the lip, and wherein the left and right strap portions are perpendicular to the left and right suspension arm portions, respectively.

9. The combination of claim 8, wherein the holder further comprises, a cup support comprising a top end having an annular lip extending radially outwardly thereform, the annular lip being coupled with and supported by the cup-receiving ring.

10. The combination of claim 8, wherein each strap portion has a multi-ridged first end section and the opposing second end section having a keyhole opening, the first end section having a plurality of annular ridges having a first diameter separated and spaced from each other by one or more annular valleys having a second diameter, the keyhole opening having partially intersecting generally circular first and second opening portions.

* * * * *